US006936136B2

(12) United States Patent
Shannon et al.

(10) Patent No.: US 6,936,136 B2
(45) Date of Patent: Aug. 30, 2005

(54) AMINO-FUNCTIONALIZED PULP FIBERS

(75) Inventors: Thomas G. Shannon, Neenah, WI (US); David Moline, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 159 days.

(21) Appl. No.: 10/335,133

(22) Filed: Dec. 31, 2002

(65) Prior Publication Data

US 2004/0123962 A1 Jul. 1, 2004

(51) Int. Cl.[7] ..... D21H 10/22

(52) U.S. Cl. ..... 162/9; 162/100; 162/158; 162/164.6; 162/168.2; 162/182; 162/183

(58) Field of Search ..... 162/9, 100, 147, 162/150, 123, 146, 157.6, 184, 135, 109, 111, 112, 164.6, 168.2, 158, 182, 183; 8/196

(56) References Cited

U.S. PATENT DOCUMENTS

| | | | | |
|---|---|---|---|---|
| 2,233,475 A | * | 3/1941 | Dreyfus | 536/32 |
| 2,432,127 A | * | 12/1947 | Schlosser et al. | 536/60 |
| 2,721,140 A | * | 10/1955 | Weisgerber | 525/333.9 |
| 2,961,366 A | * | 11/1960 | Weisgerber | 162/158 |
| 3,128,311 A | | 4/1964 | Shirley et al. | |
| 3,155,728 A | | 11/1964 | Lesesne | |
| 3,236,895 A | | 2/1966 | Lee et al. | |
| 3,347,926 A | | 10/1967 | Zech | |
| 3,392,084 A | | 7/1968 | Bates | |
| 3,654,370 A | | 4/1972 | Yeakey | |

(Continued)

FOREIGN PATENT DOCUMENTS

| | | | |
|---|---|---|---|
| DE | 2936239 A1 | | 3/1981 |
| EP | 0347154 A3 | | 12/1989 |
| EP | 0347154 A2 | | 12/1989 |
| GB | 1081063 | | 6/1963 |
| WO | WO 02072946 A2 | | 9/2002 |
| WO | WO 02072951 A2 | | 9/2002 |
| WO | WO 2004 025029 A1 | | 3/2004 |

OTHER PUBLICATIONS

Tappi, Freeness Scale Interconversion.*

Casey, Pulp and Paper, (1980) John Wiley & Sons, vol. II, p. 856.*

Casey, Pulp and Paper, (1980) John Wiley & Sons, vol. III, p. 1497.*

PCT Search Report for PCT/US03/36406 May 13, 2004.

Technical Bulletin from Huntsman Corporation, *The Jeffamine® Polyoxyalkyleneamines*, 6 pages.

*Primary Examiner*—Peter Chin
(74) *Attorney, Agent, or Firm*—Dority & Manning, P.A.

(57) ABSTRACT

The disclosed invention is directed to pulp fibers suitable for forming a wet-laid paper product which include amino-functionality which is non-extractable in an aqueous phase. The pulp fibers may be prepared by applying an amino-functional additive to a fibrous web prior to the finishing operation at a pulp mill. The fibrous web may then be repulped at a papermaking machine to form a paper web which includes the amino-functionalized fibers of the present invention. A paper web formed of the amino-functionalized fibers may display unique and/or improved reactivity toward certain papermaking additives. For instance, the paper webs of the disclosed invention may show dry tensile strength increases of greater than 40% when treated with a permanent wet strength agent such as a polyamine epichlorohydrin wet strength agent, whereas a paper web which does not include the amino-functionalized fibers of the present invention may show less than a 20% increase in strength properties when treated with the same strength agents.

47 Claims, 3 Drawing Sheets

U.S. PATENT DOCUMENTS

| | | | | |
|---|---|---|---|---|
| 3,700,623 | A | | 10/1972 | Keim |
| 3,772,076 | A | | 11/1973 | Keim |
| 3,855,158 | A | | 12/1974 | Petrovich et al. |
| 4,014,933 | A | | 3/1977 | Boettger et al. |
| 4,129,528 | A | | 12/1978 | Petrovich et al. |
| 4,129,722 | A | | 12/1978 | Iovine et al. |
| 4,147,586 | A | | 4/1979 | Petrovich et al. |
| 4,153,581 | A | | 5/1979 | Habermann |
| 4,210,489 | A | | 7/1980 | Markofsky |
| 4,242,408 | A | | 12/1980 | Evani et al. |
| 4,423,194 | A | | 12/1983 | Lobach et al. |
| 5,173,521 | A | | 12/1992 | Ishino |
| 5,300,192 | A | | 4/1994 | Hansen et al. |
| 5,380,403 | A | * | 1/1995 | Robeson et al. ..... 162/147 |
| 5,397,436 | A | * | 3/1995 | Robeson et al. ..... 162/158 |
| 5,494,554 | A | | 2/1996 | Edwards et al. |
| 5,547,745 | A | | 8/1996 | Hansen et al. |
| 5,607,551 | A | | 3/1997 | Farrington, Jr. et al. |
| 5,609,727 | A | | 3/1997 | Hansen et al. |
| 5,667,636 | A | | 9/1997 | Engel et al. |
| 5,672,248 | A | | 9/1997 | Wendt et al. |
| 6,368,456 | B1 | | 4/2002 | Cimecioglu et al. |
| 2002/0026992 | A1 | | 3/2002 | Antal et al. |
| 2002/0139500 | A1 | | 10/2002 | Runge et al. |
| 2002/0162243 | A1 | | 11/2002 | Runge et al. |

* cited by examiner

AMINO-FUNCTIONALIZED PULP FIBERS

BACKGROUND OF THE INVENTION

In the art of tissue making and papermaking in general, many additives have been proposed for specific purposes, such as increasing wet strength, improving softness, or control of wetting properties. For instance, in the past, wet strength agents have been added to paper products in order to increase the strength or otherwise control the properties of the product when contacted with water and/or when used in a wet environment. For example, wet strength agents are added to paper towels so that the paper towel may be used to wipe and scrub surfaces after being wetted without the towel disintegrating. Wet strength agents are also added to facial tissues to prevent the tissues from tearing when contacting fluids. In some applications, wet strength agents are also added to bath tissues to provide strength to the tissues during use. When added to bath tissues, however, the wet strength agents should not prevent the bath tissue from disintegrating when dropped in a commode and flushed into a sewer line. Wet strength agents added to bath tissues are sometimes referred to as temporary wet strength agents since they only maintain wet strength in the tissue for a specific length of time.

Typically, papermaking additives such as softeners, colorants, brighteners, strength agents, etc., are added to the fiber slurry upstream of the headbox in a papermaking machine during the manufacturing or converting stages of production to impart certain attributes to the finished product. These additives may be mixed in a stock chest or stock line where the fiber slurry has a fiber consistency of from between about 0.15 to about 5 percent or may be sprayed on to the wet or dry paper or tissue during production.

One difficulty associated with wet end additive addition is that the additives are suspended in water and must react with the cellulose through the relatively low numbers of carboxylic acid and/or aldehyde groups on the cellulose or alternatively the chemical must be cationic and attach via ionic attractions between itself and the anionic fiber. To improve absorption of wet end additives, the additives are often modified with functional groups to impart an electrical charge when in water. The electrokinetic attraction between charged additives and the anionically charged fiber surfaces aids in the deposition and retention of additives onto the fibers. Nevertheless, the amount of the additive that may be absorbed or retained in the paper machine wet end generally is limited to the number of anionic sites on the fiber and/or the number of reactive functionalities on the fiber. As a result, the absorption of additives may be significantly less than 100 percent, particularly when trying to achieve high additive loading levels.

Consequently, at any chemical level, and particularly at high addition levels, a fraction of the additive is retained on the fiber surface. The remaining fraction of the additive remains dissolved or dispersed in the suspending water phase. These unabsorbed or unretained additives may cause a number of problems in the papermaking process. The exact nature of the additive will determine the specific problems that may arise, but a partial list of problem that may result from unabsorbed or unretained additives includes: foam, deposits, contamination of other fiber streams, poor fiber retention on the machine, compromised chemical layer purity in multi-layer products, dissolved solids build-up in the water system, interactions with other process chemicals, felt or fabric plugging, excessive adhesion or release on dryer surfaces, and physical property variability in the finished product.

In addition, the amount of additive which may be retained on the fibers may be limited by the reactivity of the fiber, defined at least in part by the number of reactive sites on the fiber surface. As such, the desired characteristics of the paper product, such as wet and dry strength characteristics, for example, are also limited.

While cellulose fiber has been physically modified in the past through chemical treatment or enzyme treatment in order to increase the reactivity of the fiber with specific additives, these known treatments may be costly and difficult to control.

Therefore, what is lacking and needed in the art is a method for increasing the reactivity of a papermaking fiber and through that improving the physical characteristics of a web formed of the fibers due to the increased reactivity between the fibers and papermaking additives. In addition, increased reactivity of papermaking fibers may expand the number of possible additives which may be used in a papermaking process as well as minimize the excess additive in the suspending water phase due to increased absorption efficiency of the additive by the papermaking fibers.

SUMMARY OF THE INVENTION

According to one embodiment of the present invention, a papermaking fiber is disclosed displaying improved reactivity toward papermaking additives. More specifically, the papermaking fiber of the present invention includes a cellulosic fiber and an amino-functional additive adhered to the cellulosic fiber.

The amino-functional additive may generally have a primary amine content greater than about 0.90 m-eq per gram of additive. In one embodiment, the amino-functional additive may have a primary amine content greater than about 0.94 m-eq per gram of additive.

The amino-functional additive may generally be non-extractable from the cellulosic fibers in an aqueous medium. That is, the amino-functional additive may have a retention level on the cellulosic fiber of at least about 50% under aqueous conditions. In one embodiment, the amino-functional additive may have a retention level on the cellulosic fiber of at least about 60% under aqueous conditions. In another embodiment, the amino-functional additive may have a retention level on the cellulosic fiber of at least about 75% under aqueous conditions.

In one embodiment, the amino-functional additive may be a polymeric amino-functional additive such as, for example, a polyvinylamine or a polyoxyalkylpolyamine.

The amino-functional additive may be adhered to the cellulosic fiber via any suitable method. For example, in one embodiment the additive may be bonded to the fiber, for instance with a covalent bond, though this is not a requirement of the present invention.

The amino-functionalized papermaking fibers of the present invention may have Canadian Standard Freeness value of greater than about 200 in certain embodiments. In one embodiment, the amino-functionalized papermaking fiber may have a CSF of greater than about 500.

The amino-functionalized fibers may be formed of any suitable papermaking fibers. For instance the amino-functionalized fibers may be virgin fibers or high yield pulp fibers.

The present invention is also directed to a paper web formed from the amino-functionalized fibers. The paper web may generally include the amino-functionalized fibers and a papermaking additive which is capable of reacting with the amino-functionalized papermaking fibers. For example, the papermaking additive may be a wet strength agent, either a temporary or a permanent wet strength agent, or alternatively a polymeric anionic reactive compound or a polymeric aldehyde functional compound. The papermaking additives may generally be added to the web in an amount of between about 0.1% and about 10% based on the weight of the web.

In one embodiment, the paper web may include a wet strength papermaking additive and may display a dry tensile index at least about 40% greater than the dry tensile index of an equivalent web which has not been treated with a wet strength agent.

The paper web of the present invention may be formed solely of the amino-functionalized fibers of the invention or alternatively may be formed of a mix of papermaking fibers. For example, the paper web may include between about 10% and about 100% amino-functionalized papermaking fibers. In one embodiment, the paper web may include about 50% amino-functionalized papermaking fibers by weight mixed with other papermaking fibers.

The paper web may be any desired style or type of paper web including, for example, an uncreped, through-dried paper web, a creped web, a stratified web, etc.

The present invention is also directed to a method for forming amino-functionalized pulp fiber which comprises creating a fiber slurry. The fiber slurry comprises water and papermaking fibers. The fiber slurry is passed to a web-forming apparatus of a pulp sheet machine where a wet fibrous web is formed from the fiber slurry. The wet fibrous web is dewatered to a predetermined consistency, thereby forming a dewatered fibrous web. An amino-functional additive is then applied to the dewatered fibrous web. The resulting chemically treated fibrous web contains amino-functionalized pulp fibers that may retain at least about 50 percent of the applied amount of the amino-functional additive when the amino-functionalized pulp fibers are redispersed in water.

In one embodiment, the chemically treated dried fibrous web is mixed with process water to form an amino-functionalized pulp fiber slurry. The slurry contains the fibers having the amino-functional additive secured thereto. A finished product having enhanced quality due to the increased ability of the amino-functional pulp fibers to react with certain papermaking additives, such as, for instance, wet strength agents, may be produced from the chemically treated pulp fiber slurry.

DEFINITIONS AND TEST METHODS

The term "dried fibrous web" refers to a fibrous web that has a consistency of from about 65 to about 100 percent. In some embodiments, the consistency of a dried fibrous web may be from about 80 to about 100 percent or from about 85 to about 95 percent.

The term "dewatered fibrous web" refers to a fibrous web that has a consistency from about 20 to about 65 percent. In some embodiments, the consistency of a dewatered fibrous web may be from about 40 to about 65 percent or from about 50 to about 65 percent.

The term "crumb form" refers to pulp fiber having a consistency of from about 30 to about 85 percent. In some embodiments, the consistency of the crumb form may be from about 30 to about 60 percent or from about 30 to about 45 percent.

The term "retained" refers to any portion of an additive that is retained by the pulp fiber after the fiber is suspended in water during the redispersion or repulping of the fibers.

The retention of a chemical additive on papermaking fibers when used in the wet end of a wet-laid web forming process was determined in the following manner: 25 grams of eucalyptus fibers treated according to the processes of the present invention were dispersed in 2000 cc distilled water at approximately 40° F. for 5 minutes in a British Pulp Disintegrator (available from Lorentzen and Werte, Inc., Atlanta, Ga.). The pulp slurry was then diluted to about 0.3% consistency. The appropriate amount of the 0.3% slurry necessary to form a 60 gsm handsheet on a square (9"×9") Valley Handsheet Mold (available from Vioth, Inc., Appleton, Wis.) was poured into the mold that was partially filled with water. The mold was then filled to about 8 liters total volume with water. The fibers suspended in the handsheet mold water were then mixed using a perforated plate attached to a handle to uniformly disperse the fibers within the entire volume of the mold. After mixing, the sheet was formed by draining the water in the mold, thus depositing the fibers on the 90×90 mesh forming wire. The sheet was removed from the forming wire using blotters and a couch roll. The wet sheet was then pressed wire side up at 100 psi for 2 minutes and then transferred to a steam heated convex surface metal dryer (such as, for example, a Valley Steam Hotplate dryer available from Voith, Inc., Appleton, Wis.) maintained at 213° F. (±2° F.). The sheet was held against the dryer by use of a canvas under tension. The sheet was allowed to dry for 2 minutes on the metal surface; and was then removed. The content of the additive in the treated pulp fibers before and after handsheet preparation was determined. The retention may be expressed in terms of the following equation:

$$\text{Retention}=(\%\ \text{additive in handsheet})\div(\%\ \text{additive in treated fibers})$$

The term "web-forming apparatus" includes fourdrinier former, twin wire former, cylinder machine, press former, crescent former, and the like used in the pulp stage known to those skilled in the art.

The term "water" refers to water or a solution containing water and other treatment additives desired in the papermaking process.

The term "additive" refers to a single treatment compound or to a mixture of treatment compounds.

The term "water soluble" refers to solids liquids that will form a solution in water, and the term "water dispersible" refers to solids or liquids of colloidal size or larger that may be dispersed into an aqueous medium.

The term "bonding agent" refers to any chemical that may be incorporated into tissue to increase or enhance the level of interfiber or intrafiber bonding in the sheet. The increased bonding may be either ionic, Hydrogen or covalent in nature. It is understood that a bonding agent refers to both dry and wet strength enhancing chemical additives.

As used herein, "viscosity" is measured with a Sofrasser SA Viscometer (Villemandeur, France) connected to a type MIVI-6001 measurement panel. The viscometer employs a vibrating rod which responds to the viscosity of the surrounding fluid. To make the measurement, a 30 ml glass tube (Corex H No. 8445) supplied with the viscometer is filled with 10.7 ml of fluid and the tube is placed over the vibrating rod to immerse the rod in fluid. A steel guide around the rod receives the glass tube and allows the tube to be completely inserted into the device to allow the liquid depth over the vibrating rod to be reproducible. The tube is held in place for 30 seconds to allow the centipoise reading on the measurement panel to reach a stable value.

Unless otherwise specified, "tensile strengths" are measured according to Tappi Test Method T 494 om-88 for tissue, modified in that a tensile tester is used having a 3-inch jaw width, a jaw span of 4 inches, and a crosshead speed of 10 inches per minute. Wet strength is measured in the same manner as dry strength except that the tissue sample is folded without creasing about the midline of the sample, held at the ends, and dipped in deionized water for about 0.5 seconds to a depth of about 0.5 cm to wet the central portion of the sample, whereupon the wetted region is touched for about 1 second against an absorbent towel to remove excess drops of fluid, and the sample is unfolded and set into the tensile tester jaws and immediately tested. The sample is conditioned under TAPPI conditions (50% RH, 22.7° C.) before testing. Generally 3 samples are combined for wet tensile testing to ensure that the load cell reading is in an accurate range. Unless otherwise specified, the dry and wet tensile properties of machine-made webs are taken in the machine direction of the web.

"Tensile index" (TI) is a measure of tensile strength normalized for basis weight of the web tested in both dry and wet states. Tensile strength can be converted to tensile index by converting tensile strength determined in units of grams of force per 3 inches to units of Newtons per meter and dividing the result by the basis weight in grams per square meter of the tissue, to give the tensile index in Newton-meters per gram (Nm/g).

BRIEF DESCRIPTION OF THE FIGURES

A full and enabling disclosure of the present invention, including the best mode thereof to one of ordinary skill in the art, is set forth more particularly in the remainder of the specification, including reference to the accompanying figures in which.

Figure 1:
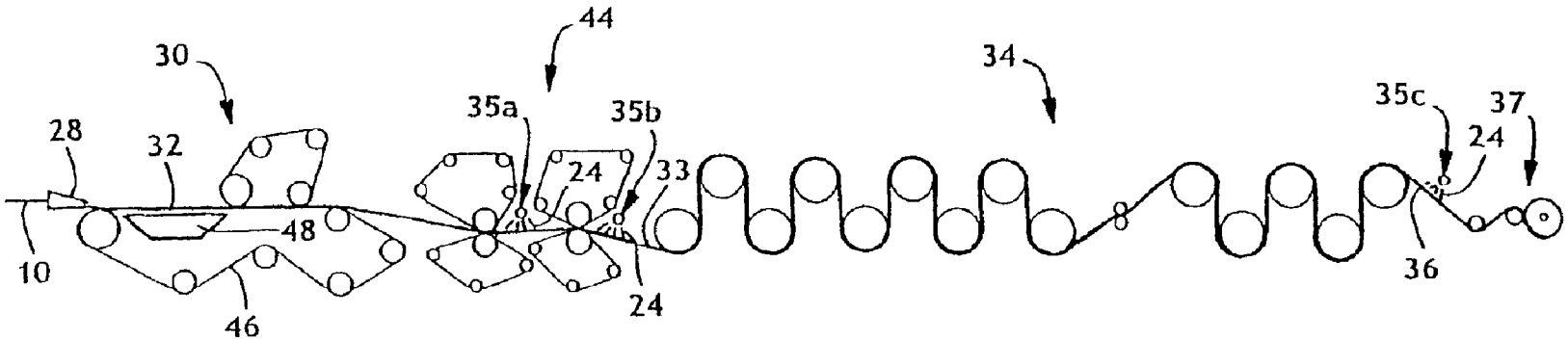
FIG. 1 depicts a schematic process flow diagram of a method according to the present invention for creating amino-functionalized pulp fibers.

Repeat use of reference characters in the present specification and drawings is intended to represent same or analogous features or elements of the present invention.

DETAILED DESCRIPTION OF THE INVENTION

Reference now will be made in detail to embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention cover such modifications and variations as come within the scope of the appended claims and their equivalents.

It has been discovered that cellulose fibers may be pretreated so as to have increased reactivity toward papermaking additives. In particular, it has been discovered that fibers may be prepared having amine functionality, specifically primary amine functionality. The amino-functionalized fibers prepared according to the present invention may then be utilized in forming a wet-laid paper product. The amino-functionalized fibers may display increased reactivity with certain papermaking additives as compared to pulp fibers which have not been treated so as to have amino-functionality. In general, amino-functionalization of the fiber may be accomplished by treating a fibrous web prior to the finishing operation at a pulp mill with an amino-functional chemical or polymer additive that adheres to the fiber during the finishing operation, completing the finishing operation, redispersing (or repulping) the finished pulp and using the amino-functionalized pulp in the production of a wet-laid paper product.

In general, the present invention is applicable to any papermaking fibers which may be utilized in a wet-laid papermaking process.

"Papermaking fibers," as used herein, include all known cellulosic fibers or fiber mixes comprising cellulosic fibers. As used herein, the term "cellulosic" is meant to include any material having cellulose as a major constituent, and specifically comprising at least 50 percent by weight cellulose or a cellulose derivative. Thus, the term includes cotton, typical wood pulps, nonwoody cellulosic fibers, cellulose acetate, cellulose triacetate, rayon, thermomechanical wood pulp, chemical wood pulp, debonded chemical wood pulp, milkweed, or bacterial cellulose.

Fibers suitable for making the webs of this invention may include any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers may be prepared in high-yield or low-yield forms and may be pulped in any known method, including kraft, sulfite, high-yield pulping methods and other known pulping methods. Fibers prepared from organosolv pulping methods may also be used. Useful fibers may also be produced by anthraquinone pulping.

Synthetic cellulose fiber types including rayon in all its varieties and other fibers derived from viscose or chemically modified cellulose may also be amino-functionalized according to the present invention. Chemically treated natural cellulosic fibers may be used such as mercerized pulps, chemically stiffened or crosslinked fibers, or sulfonated fibers. For good mechanical properties in the products made with the amino-functionalized fibers, it may be desirable that the fibers be relatively undamaged and largely unrefined or only lightly refined. While recycled fibers may be used, virgin fibers are generally useful for their mechanical properties and lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof. In certain embodiments capable of high bulk and good compressive properties, the fibers may have a Canadian Standard Freeness of at least 200, more specifically at least 300, more specifically still at least 400, and most specifically at least 500.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers may have lignin content by mass of about 1% or greater, more specifically about 3% or greater, and still more specifically from about 2% to about 25%. Likewise, high yield fibers may have a kappa number greater than 20, for example. In one embodiment, the high-yield fibers are predominately softwood, such as northern softwood or, more specifically, northern softwood BCTMP.

In one aspect, the invention resides in a method for pre-treating papermaking fibers with an amino-functional chemical or polymer additive that adheres to the pulp fibers. The method generally includes creating a fiber slurry comprising water and pulp fibers. The fiber slurry may then be formed into a wet fibrous web using a web forming apparatus. The wet fibrous web may be dewatered to a predetermined consistency, thereby forming a dewatered fibrous web. An amino-functional additive may then be applied to the dewatered fibrous web, forming a pre-treated dewatered fibrous web. In other embodiments of the present invention, the process may include further dewatering of the dewatered fibrous web, forming a crumb-form before or after the application of the amino-functional additive.

In general, the amino-functional additives useful in the present invention may include compounds that contain primary amine groups, such as, for example polyamines containing primary amine groups. For instance, amino-functional additives may be used containing at least about 0.90 m-eq primary amine per gram of additive. In one embodiment, amino-functional additives be used which contain at least about 0.94 m-eq primary amine/gram additive.

A non-exclusive list of possible amino-functional additives which ay be used in the present invention may include, for example, polyvinylamines, polyallylamines, chitosan, polyethyleneimine, polyoxyalkylpolyamines or mixtures of polyamines. In general, the additives may be water-soluble, water-insoluble, or partially water-soluble. The amino-functional additive, once adhered to the fiber, should be essentially non-extractable in an aqueous solution. For purposes of this disclosure, non-extractable in an aqueous solution is defined to mean that at least bout 50% of the additive will remain adhered to the fibers when the fibers are saturated with an aqueous solution.

In those embodiments wherein a water-soluble amino-functional additive is used, in order that the additive be non-extractable in an aqueous solution, a bonding mechanism may be present between the fibers and the additive. For example, an ionic, covalent, coordinate covalent, or hydrogen bond may be present between the additive and the fiber. While not wishing to be bound by theory, it is believed that amino groups on the amino-functional additive can form hydrogen bonds with hydroxyl groups on the cellulose or covalent bonds with functional groups on the cellulose, such as aldehyde groups that may have been added by enzymatic or chemical treatment, or with carboxyl groups on the cellulose that may have been provided by chemical treatment such as certain forms of bleaching or ozonation. In those embodiments employing a covalent bonding mechanism formed between the amino-functional additive and the fiber, a minimal amount of fiber to fiber bonding is preferred, so as to maintain the ability of the fibers to be repulped without formation of nits.

In other embodiments, the amino-functional additive need not be bonded to the cellulosic fiber, but may be adhered to the fiber through another mechanism such as, for instance electrostatic attraction between the fiber and the amino-functional additive.

Water insoluble additives as used herein refer to materials having little to no solubility in water. For example, water insoluble additives of the present invention may have water solubilities less than about 3 g/100 cc deionized water, specifically less than about 2 g/100 cc deionized water, and in one embodiment less than about 1 g/100 cc deionized water. Solubility as referred to herein refers to the solubility of the active chemical additive not including the vehicle in which the chemical additive is delivered. It is to be understood that some of the hydrophobic chemicals useful in the present invention may be made water dispersible with use of sufficient emulsifier additives although the specific active hydrophobic additive is still water insoluble. Additives as used herein may refer to amino-functional additives as well as other papermaking additives.

Though amino-functional additives may be applied to papermaking fibers by use of a water based solution or emulsion in certain embodiments of the present invention, this is not a requirement of the invention. For instance amino-functionalization may also be accomplished through the use of organic solvents or other fluids such as super critical $CO_2$, for example. Alternative methods for applying the amino-functional additive to the pulp fibers are also envisioned according to the present invention. For example, the additive could be applied to the fibers in a dry state and then adhered to the fibers through application of thermal, kinetic, or light energy.

In one embodiment, a polyvinylamine may be used to add amino-functionality to a papermaking fiber. In general, any suitable polyvinylamine containing at least about 0.90 m-eq primary amine/gram may be used in the present invention. For instance, the polyvinylamine polymer may be a homopolymer or may be a copolymer.

Useful copolymers of polyvinylamine include those prepared by hydrolyzing polyvinylformamide to various degrees to yield copolymers of polyvinylformamide and polyvinylamine. Exemplary materials include the Catiofast® series sold commercially by BASF (Ludwigshafen, Germany).

In one embodiment, a polyvinylamine polymer having a molecular weight in the range of about 300,000 to 1,000,000 Daltons may be used, though polyvinylamine compounds having any practical molecular weight range may be used. For example, polyvinylamine polymers may have a molecular weight range of from about 5,000 to 5,000,000, more specifically from about 50,000 to 3,000,0000, and most specifically from about 80,000 to 500,000 may be used. The degree of hydrolysis for polyvinylamines formed by hydrolysis of polyvinylformamide or a copolymer of polyvinylformamide or derivatives thereof, may be about any of the following or greater: 10%, 20%, 30%, 40%, 50%, 60%, 70%, 80%, 90%, and 95%, with exemplary ranges of from about 30% to about 100%, or from about 50% to about 95%.

In one embodiment, polyoxyalkylpolyamines such as "polyether amines" sold under the brand name Jeffamine® by the Huntsman Corporation may be used as the amino-functional additive of the present invention. For example, in one embodiment, amine-terminated polyoxypropylene diols having the general structure:

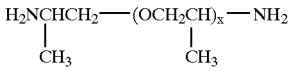

wherein x = 2–100 and an average molecular weight of approximately 2,000 may be used to form the amino-functionalized pulp fibers of the present invention.

In another embodiment, Jeffamines® such as propylene oxide based triamines may be used including, for example, those having the following general structure:

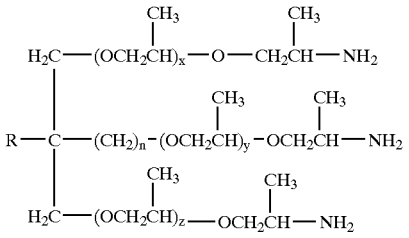

wherein, R = H, $C_2H_5$ and
n = 0, 1

The application of the amino-functional additives to the pulp fibers may be carried out in a wide variety of pulp finishing processes, including dry lap pulp, wet lap pulp, crumb pulp, and flash dried pulp operations, for example. By way of illustration, various pulp-finishing processes (also referred to as pulp processing) are disclosed in *Pulp and Paper Manufacture: The Pulping of Wood*, $2^{nd}$ Ed., Volume 1, Chapter 12, Ronald G. MacDonald, editor, which is herein incorporated by reference. Various methods may be used to apply the amino-functional additives in the present invention, including, but not limited to: spraying, coating, foaming, printing, size pressing, or any other method known in the art.

The invention will now be described in greater detail with reference to the Figures. A variety of conventional pulping apparatuses and operations may be used with respect to the pulping phase, pulp processing, and drying of pulp fiber. It is understood that the pulp fibers could be virgin pulp fiber or recycled pulp fiber. Nevertheless, particular conventional components are illustrated for purposes of providing the context in which)the various embodiments of the present invention may be used.

FIG. 1 depicts one possible embodiment of pulp processing preparation equipment which may be used to apply amino-functional additives to pulp fibers according to the present invention. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The web fibrous web 32 may be subjected to mechanical pressure to remove process water. It is understood that the process water may contain process chemicals used in treating the fiber slurry 10 prior to a web formation step. In the illustrated embodiment, the fourdrinier section 30 precedes a press section 44, although alternative dewatering devices such as a nip thickening device, or the like may be used in a pulp sheet machine. The fiber slurry 10 is deposited onto a foraminous fabric 46 such that the fourdrinier section filtrate 48 is removed from the web fibrous web 32. The fourdrinier section filtrate 48 comprises a portion of the process water. The press section 44 or other dewatering device known in the art suitably increases the fiber consistency of the wet fibrous web 32 to about 30 percent or greater, and particularly about 40 percent or greater thereby creating a dewatered web 33. The process water removed as fourdrinier section filtrate 48 during the web-forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an air-dry consistency, thereby forming a dried fibrous web 36. The dried fibrous web 36 is thereafter wound on a reel 37 or slit, cut into sheets, and baled via a baler 40 (see FIG. 2) for delivery to paper machines 38 (see FIG. 3).

An amino-functional additive 24 may be added or applied to the dewatered fibrous web 33 or the dried fibrous web 36 at a variety of addition points 35*a*, 35*b*, and 35*c* as shown in FIG. 1. It is understood that while only three addition points 35*a*, 35*b*, and 35*c* are shown in FIG. 1, the application of the amino-functional additive 24 may occur at any point between the point of initial dewatering of the wet fibrous web 32 to the point when the dried fibrous web 36 is wound on the reel 37 or based for transport to the paper machines 38. The addition point 35*a* shows the addition of the amino-functional additive 24 within press section 44. The addition point 35*b* shows the addition of the amino-functional additive 24 between the press section 44 and the dryer section 34. The addition point 35*c* shows the addition of the amino-functional additive 24 between the dryer section 34 and the reel 37 or baler 40. In certain embodiments, a curing step may be utilized so as to securely adhere the functional additive to the pulp fibers and ensure that the additive will not be non-extractable from the fibers during the repulping or redispersion of the fibers in a papermaking aqueous fiber slurry.

In general, drying or simple aging of the fibrous web 36 may provide sufficient cure to maintain retention of the desired functional compounds on the fibers.

In general, the amino-functionalized pulp fibers of the present invention may have an amino-functional additive retention level greater than 50% after the pre-treated fibers have been repulped, wet-laid, dewatered, and dried to form a paper web. In one embodiment, the additive may have a retention level on the fibers greater than 60%. In one embodiment, the additive may have a retention level on the fibers greater than about 75%.

Levels of the amino-functional additives retained in the fibers after repulping may range from about 0.05% to about 5% by weight of the dried fibers. In one embodiment, the amino-functional additive may be retained in the fibers in levels from about 0.1% to about 2.5% by weight of the fibers. In another embodiment, the amino-functional compound may be in the fibers in levels from about 0.25% to about 1.0% by weight of the fibers.

Figure 2:
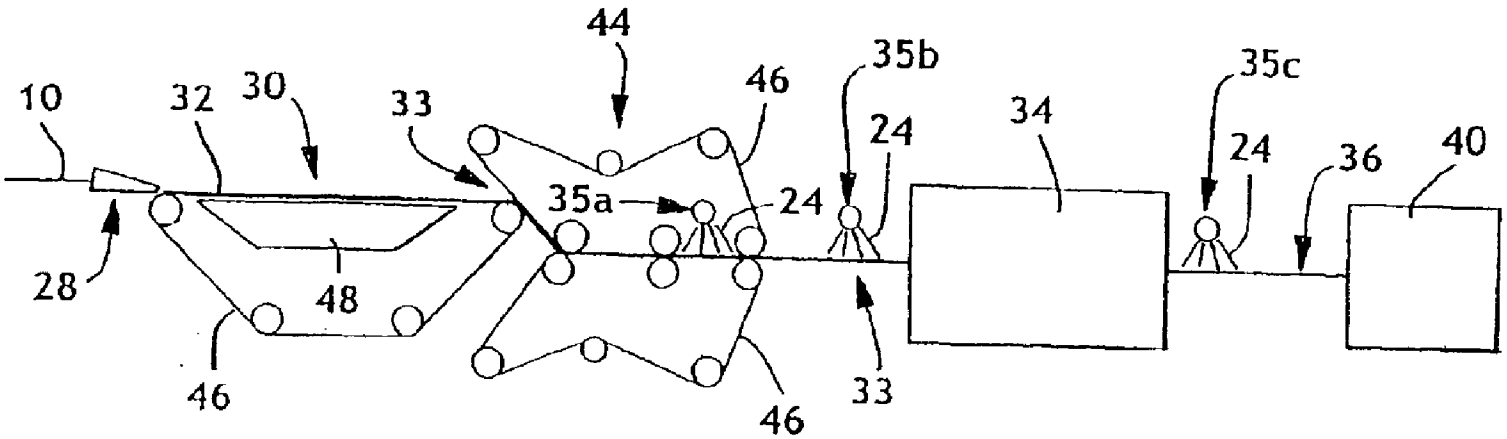
FIG. 2 depicts a schematic process flow diagram of another method according to the present invention for creating amino-functionalized pulp fibers.

FIG. 2 depicts an alternative embodiment of the present invention using a different dry lap machine to prepare and treat the pulp. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. In the illustrated embodiment, the fourdrinier section 30 precedes a press section 44, although alternative dewatering devices such as a nip thickening device, or the like known in the art may be used in a pulp sheet machine. The fiber slurry 10 is deposited onto a foraminous fabric 46 such that the fourdrinier section filtrate 48 is removed from the wet fibrous 32. The fourdrinier section filtrate 48 comprises a portion of the process water. The press section 44 or other dewatering device suitably increases the fiber consistency of the wet fibrous web 32 to about 30 percent or greater, and particularly about 40 percent or greater, thereby forming a dewatered fibrous web 33. The process water removed as fourdrinier section filtrate 48 during the web-forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an air-dry consistency, thereby forming a dried fibrous web 36. The dried fibrous web 36 is thereafter slit, cut into sheets, and baled via a baler 40 or wound on a reel 37 or wound onto a reel 37 (see FIG. 1) for delivery to paper machines 38 (see FIG. 3).

The amino-functional additive 24 may be added or applied to the dewatered fibrous web 33 or the fibrous web 36 at a variety of addition points 35*a*, 35*b*, and 35*c* as shown in FIG. 2. It is understood that while only three addition points 35*a*, 35*b*, and 35*c* are shown in FIG. 2, the application of the amino-functional additive 24 may occur at any point between the point of initial dewatering of the wet fibrous web 32 to the point the dried fibrous web 36 is wound on the reel 37 or baled for transport to the paper machines 38. The addition point 35*a* shows the addition of the amino-functional additive 24 within press section 44. The addition point 35*b* shows the addition of the amino-functional additive 24 between the press section 44 and the dryer section 34. The addition point 35*c* shows the addition of the amino-functional additive 24 between the dryer section 34 and the reel 37 or baler 40.

At the paper machines 38, (see FIG. 3) the dried fibrous web 36 may be mixed with water and the fibers repulped to form an amino-functionalized pulp fiber slurry 49. The amino-functionalized pulp fiber slurry 49 contains the pretreated pulp having the amino-functional additive 24 retained by the individual fibers. In one embodiment, the functionalized fibers may have no significant fiber degredation following the repulping process.

The paper web formed at the paper machines 38 may be formed of 100% amino-functionalized fibers or may include amino-functionalized fibers mixed with other papermaking fibers, as desired. For example, in one embodiment, a paper web may be formed including between about 10 weight percent and about 100 weight percent of the amino-functionalized fibers of the present invention.

If desired, the base web may optionally be formed from multiple layers of a fiber furnish, with the amino-functionalized fibers of the present invention in one or more layers of the web thus formed. Both strength and softness may be achieved through layered webs, such as those produced from stratified headboxes. In one embodiment, at least one layer delivered by the headbox comprises softwood fibers while another layer comprises hardwood or other fiber types. Layered structures produced by any means known in the art are within the scope of the present invention.

Referring again to FIG. 3, the fiber slurry 49 including the amino-functionalized fibers of the present invention is passed through the paper machine 38 and desired papermaking additives are applied to the nascent web to form the finished product 64. By way of illustration, various paper or tissue making processes are disclosed in U.S. Pat. No. 5,667,636 issued Sep. 16, 1997, to Engel, et al.; U.S. Pat. No. 5,607,551 issued Mar. 4, 1997, to Farrington, Jr., et al.; U.S. Pat. No. 5,672,248 issued Sep. 30, 1997, to Wendt, et al.; and U.S. Pat. No. 5,494,554 issued Feb. 27, 1996, to Edwards, et al., which are incorporated herein by reference.

The amino-functionalized fibers of the present invention may display unique and/or improved reactivity toward certain papermaking additives. Specifically, the amine functionality of the fibers may under go reactions analogous to hydroxyl groups found on cellulose fibers. Hence, the amino-functionalized fibers of the present invention may react with acids, anhydrides, aldehydes, azetidines, etc. similar to non-functionalized fibers. However, as the amine group is more nucleophilic than the hydroxy groups when both groups are present, the amino-functionalized fibers will act preferentially toward the papermaking additives, improving the characteristic enhanced by the papermaking additive in the paper web beyond that obtained by the additives when reacted with cellulose fibers which have not been amino-functionalized. Additionally, the amino-functionalized fibers may provide a greater number of reaction sites on the fibers than may exist on non-functionalized fibers, allowing more of a single additive to be absorbed by the fibers as well as allowing additional amounts of different additives to be absorbed by the fibers.

Papermaking additives which may react with the amino-functionalized fibers of the present invention in forming a paper web include any desired additive which may be held in the web due to the amine functionality. For example, papermaking additives which may show improved reactivity in a paper web may include polymeric anionic reactive compounds, polymeric aldehyde-functional compounds, permanent wet strength agents, and various anionic or noncationic (e.g. zwitterionic) surfactants.

Polymeric anionic reactive compounds (PARC), as used herein, are polymers having repeating units containing two or more anionic functional groups that may be electrostatically held to or bond with amine groups on the amino-functionalized cellulose fibers. Such compounds may cause inter-fiber crosslinking between individual cellulose fibers. In one embodiment, the functional groups are carboxylic acids, anhydride groups, or the salts thereof. In one embodiment, the repeating units include two carboxylic acid groups on adjacent atoms, particularly adjacent carbon atoms, wherein the carboxylic acid groups are capable of forming cyclic anhydrides and specifically 5-member ring anhydrides. This cyclic anhydride, in the presence of the amine groups on the functionalized fibers at elevated temperature, may form ester bonds with the amine groups. Polymers, including copolymers, terpolymers, block copolymers, and homopolymers, of maleic acid represent one embodiment, including copolymers of acrylic acid and maleic acid. Polyacrylic acid can be useful for the present invention if a significant portion of the polymer (e.g., 15% of the monomeric units or greater, more specifically 40% or greater, more specifically still 70% or greater) comprises monomers that are joined head to head, rather than head to tail, to ensure that carboxylic acid groups are present on adjacent carbons. In one embodiment, the polymeric anionic reactive compound is a poly-1,2-diacid.

Exemplary polymeric anionic reactive compounds include the ethylene/maleic anhydride copolymers described in U.S. Pat. No. 4,210,489 to Markofsky, herein incorporated by reference. Vinyl/maleic anhydride copolymers and copolymers of epichlorohydrin and maleic anhydride or phthalic anhydride are other examples. Copolymers of maleic anhydride with olefins can also be considered, including poly (styrene/maleic anhydride), as disclosed in German Patent No. 2,936,239. Copolymers and terpolymers of maleic anhydride that can be used are disclosed in U.S. Pat. No. 4,242,408 to Evani et al., herein incorporated by reference. Examples of polymeric anionic reactive compounds include terpolymers of maleic acid, vinyl acetate, and ethyl acetate known as BELCLENE@ DP80 (Durable Press 80) and BELCLENE@ DP60 (Durable Press 60), from FMC Corporation (Philadelphia, Pa.).

Other polymers of value can include maleic anhydride-vinyl acetate polymers, polyvinyl methyl ether-maleic anhydride copolymers, such as the commercially available Gantrez-AN119 from International Specialty Products (Calvert City, Ky.), isopropenyl acetate-maleic anhydride copolymers, itaconic acid-vinyl acetate copolymers, methyl styrene-maleic anhydride copolymers, styrene-maleic anhydride copolymers, methylmethacrylate-maleic anhydride copolymers, and the like.

The polymeric anionic reactive compound can have any viscosity provided that the compound can be applied to the web. In one embodiment, the polymeric anionic reactive compound has a relatively low molecular weight and thus a low viscosity to permit effective spraying or printing onto a web. Useful polymeric anionic reactive compounds according to the present invention can have a molecular weight less than about 5,000, with an exemplary range of from about 500 to 5,000, more specifically less than about 3,000, more specifically still from about 600 to about 2,500, and most specifically from about 800 to 2,000 or from about 500 to 1,400. The polymeric anionic reactive compound BELCLENE@ DP80, for instance, is believed to have a molecular weight of from about 800 to about 1000. As used herein, molecular weight refers to number averaged molecular weight determined by gel permeation chromatography (GPC) or an equivalent method.

The polymeric anionic reactive compound can be a copolymer or terpolymer to improve flexibility of the molecule relative to the homopolymer alone. Improved flexibility of the molecule can be manifest by a reduced glass transition temperature as measured by differential scanning calorimetry. In aqueous solution, a low molecular weight compound such as BELCLENE® DP80 will generally have a low viscosity, simplifying the processing and application of the compound. In particular, low viscosity is useful for spray application, whether the spray is to be applied uniformly or non-uniformly (e.g., through a template or mask) to the product. A saturated (50% by weight) solution of BELCLENE© DP80, for example, has a room temperature viscosity of about 9 centipoise, while the viscosity of a solution diluted to 2%, with 1% SHP catalyst, is approximately 1 centipoise (only marginally greater than that of pure water).

Another useful aspect of the polymeric anionic reactive compounds of the present invention is that relatively high pH values can be used when a catalyst is present, making the compound more suitable for neutral and alkaline papermaking processes and more suitable for a variety of processes, machines, and fiber types. In particular, polymeric anionic reactive compound solutions with added catalyst can have a pH above 3, more specifically above 3.5, more specifically still above 3.9, and most specifically of about 4 or greater, with an exemplary range of from 3.5 to 7 or from 4.0 to 6.5.

The polymeric anionic reactive compounds of the present invention can yield very high wet:dry tensile ratios in a web containing the amino-functionalized fibers of the present invention, with values reaching ranges as high as from 30% to 85%, for example. The PARC need not be neutralized prior to application to the web. In particular, the PARC need not be neutralized with a fixed base. As used herein, a fixed base is a monovalent base that is substantially nonvolatile under the conditions of treatment, such as sodium hydroxide, potassium hydroxide, or sodium carbonate, and t-butylammonium hydroxide. However, it can be desirable to use co-catalysts, including volatile basic compounds such as imidazole or triethyl amine, with sodium hypophosphite or other catalysts.

Without wishing to be bound by the following theory, it is believed amino groups on the amino-functionalized fibers can react with the polymeric anionic reactive compound, particularly with carboxyl groups to yield a polyelectrolyte complex (sometimes termed a coacervate) that upon heating, may react to form amide bonds that crosslink the two molecules, leaving a hydrophobic backbone. Other carboxyl groups on the polymeric anionic reactive compound can form ester cross links with hydroxyl groups on the cellulose, The result is a treated web with added cross linking for wet and dry strength properties, with a high degree of hydrophobicity due to depleted hydrophilic groups on the reacted polymers.

In one embodiment, the polymeric anionic reactive compound can be used in conjunction with a catalyst. Suitable catalysts for use with PARC include any catalyst that increases the rate of bond formation between the PARC and the amino-functional fibers. Useful catalysts include alkali metal salts of phosphorous containing acids such as alkali metal hypophosphites, alkali metal phosphites, alkali metal polyphosphonates, alkali metal phosphates, and alkali metal sulfonates. Particularly desired catalysts include alkali metal polyphosphonates such as sodium hexametaphosphate, and alkali metal hypophosphites such as sodium hypophosphite. Several organic compounds are known to function effectively as catalysts as well, including imidazole (IMDZ) and triethyl amine (TEA). Inorganic compounds such as aluminum chloride and organic compounds such as hydroxyethane diphosphoric acid can also promote crosslinking. Other specific examples of effective catalysts are disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate and potassium dihydrogen phosphate.

When a catalyst is used to promote bond formation, the catalyst is typically present in an amount in the range from about 5 to about 100 weight percent of the PARC. The catalyst is present in an amount of about 25 to 75% by weight of the PARC, most desirably about 50% by weight of the PARC.

Besides polymeric anionic reactive compounds, another class of compounds that can be used with amino-functionalized fibers to improve web properties in accordance with the present invention are polymeric aldehyde-functional compounds.

In general, polymeric aldehyde-functional compounds can be used with the amino-functionalized fibers of the present invention to create improved physical and chemical properties in the resulting web. The polymeric aldehyde-functional compounds can comprise gloxylated polyacrylamides, aldehyde-rich cellulose, aldehyde-functional polysaccharides, and aldehyde functional cationic, anionic or non-ionic starches. Exemplary materials include those disclosed by Lovine, et al., in U.S. Pat. No. 4,129,722, herein incorporated by reference. An example of a commercially available soluble cationic aldehyde functional starch is Cobond® 1000 marketed by National Starch. In general, a polymeric aldehyde-functional compound can have a molecular weight of about 10,000 or greater, more specifically about 100,000 or greater, and more specifically about 500,000 or greater. Alternatively, the polymeric aldehyde-functional compounds can have a molecular weight below about 200,000, such as below about 60,000.

Further examples of aldehyde-functional polymers of use in the present invention include dialdehyde guar, aldehyde-functional wet strength additives further comprising carboxylic groups, dialdehyde inulin, and dialdehyde-modified anionic and amphoteric polyacrylamides. Aldehyde-containing surfactants can also be used.

When used in the present invention, an aldehyde-functional compound can have at least 5 milliequivalents (m-eq) of aldehyde per 100 grams of polymer, more specifically at least 10 m-eq, more specifically still about 20 m-eq or greater, and most specifically about 25 m-eq per 100 grams of polymer or greater.

In one embodiment, amino-functional fibers, when combined with an aldehyde-functional compound in a web, can significantly increase wet and dry strength of the web, and these gains can be achieved without the need for temperatures above the normal drying temperatures of paper webs (e.g., about 100° C.).

In another embodiment, the polymeric aldehyde-functional compound can be a glyoxylated polyacrylamide, such as a cationic glyoxylated polyacrylamide. Such compounds include PAREZ 631 NC wet strength resin available from Cytec Industries of West Patterson, N.J., chloroxylated polyacrylamides, and HERCOBOND 1366, manufactured by Hercules, Inc. of Wilmington, Del. Another example of a glyoxylated polyacrylamide is PAREZ 745, which is a glyoxylated poly (acrylamide-co-diallyl dymethyl ammonium chloride). At times it may be advantageous to utilize a mixture of high and low molecular weight glyoxylated polyacrylamides to obtain a desire effect.

The above described cationic glyoxylated polyacrylamides have been used in the past as wet strength agents. In particular, the above compounds are known as temporary wet strength additives. As used herein, a temporary wet strength agent, as opposed to a permanent wet strength agent, is defined as those resins which, when incorporated into paper or tissue products, will provide a product which retains less than 50% of its original wet strength after exposure to water for a period of at least 5 minutes. Permanent wet strength agents, on the other hand, provide a product that will retain more than 50% of its original wet strength after exposure to water for a period of at least 5 minutes. In one embodiment of the present invention, when a glyoxylated polyacrylamide, which is known to be a temporary wet strength agent, is combined with amino-functional fibers in a paper web, the combination of the two components can result in permanent wet strength characteristics.

In accordance with the present invention, various other papermaking additives can also be combined with the amino-functional fibers. For instance, in one application, other wet strength agents not identified above can be used. For example, polyamine-amide epichlorohydrin wet strength agents, such as those available under the Kymene® label from Hercules, Inc. of Wilmington, Del. may be combined with the amino-functional fibers of the present invention to produce a paper Web with improved wet strength characteristics.

As used herein, "wet strength agents" are materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it can be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph and other body exudates.

Any material that when added to a paper web or sheet results in providing the sheet with a mean wet geometric tensile strength: dry geometric tensile strength ratio in excess of 0.1 will, for purposes of this invention, be termed a wet strength agent. As described above, typically these materials are termed either as permanent wet strength agents or as temporary wet strength agents.

By way of example only, the papermaking additives may be applied to the paper web containing the amino-functional fibers of the present invention by any method known in the art including, for example:

- Direct addition to a fibrous slurry, such as by injection of the additive into a slurry prior to entry in the headbox. Slurry consistency can be from 0.2% to about 50%, specifically from about 0.2% to 10%, more specifically from about 0.3% to about 5%, and most specifically from about 1% to 4%.
- A spray applied to a fibrous web. For example, spray nozzles may be mounted over a moving paper web to apply a desired dose of an additive to a web that can be moist or substantially dry.
- Application of the additive by spray or other means to a moving belt or fabric which in turn contacts the tissue web to apply the chemical to the web.
- Printing onto a web, such as by offset printing, gravure printing, flexographic printing, ink jet printing, digital printing of any kind, and the like.
- Coating onto one or both surfaces of a web, such as blade coating, air knife coating, short dwell coating, cast coating, and the like.
- Extrusion from a die head of additive in the form of a solution, a dispersion or emulsion, or a viscous mixture comprising the additive and a wax, softener, debonder, oil, polysiloxane compound or other silicone agent, an emollient, a lotion, an ink, or other additive.
- Application to individualized amino-functionalized fibers. For example, comminuted or flash dried fibers may be entrained in an air stream combined with an aerosol or spray of the compound to treat individual fibers prior to incorporation into a web or other fibrous product.
- Impregnation of a wet or dry web with a solution or slurry, wherein the additive penetrates a significant distance into the thickness of the web, such as more than 20% of the thickness of the web, more specifically at least about 30% and most specifically at least about 70% of the thickness of the web, including completely penetrating the web throughout the full extent of its thickness.
- Foam application of the additive to a fibrous web (e.g., foam finishing), either for topical application or for impregnation of the additive into the web under the influence of a pressure differential (e.g., vacuum-assisted impregnation of the foam).

Padding of a solution of the additive into an existing fibrous web.

Roller fluid feeding of a solution of the additive for application to the web.

When applied to the surface of a paper web, topical application of the additive can occur on an embryonic web prior to Yankee drying or through drying, and optionally after final vacuum dewatering has been applied.

The application level of an additive can generally be from about 0.1% to about 10% by weight relative to the dry mass of the web. More specifically, the application level can be from about 0.1% to about 4%, or from about 0.2% to about 2%. Higher and lower application levels are also within the scope of the present invention. In some embodiments, for example, application levels of from 5% to 50% or higher can be considered.

Figure 3:
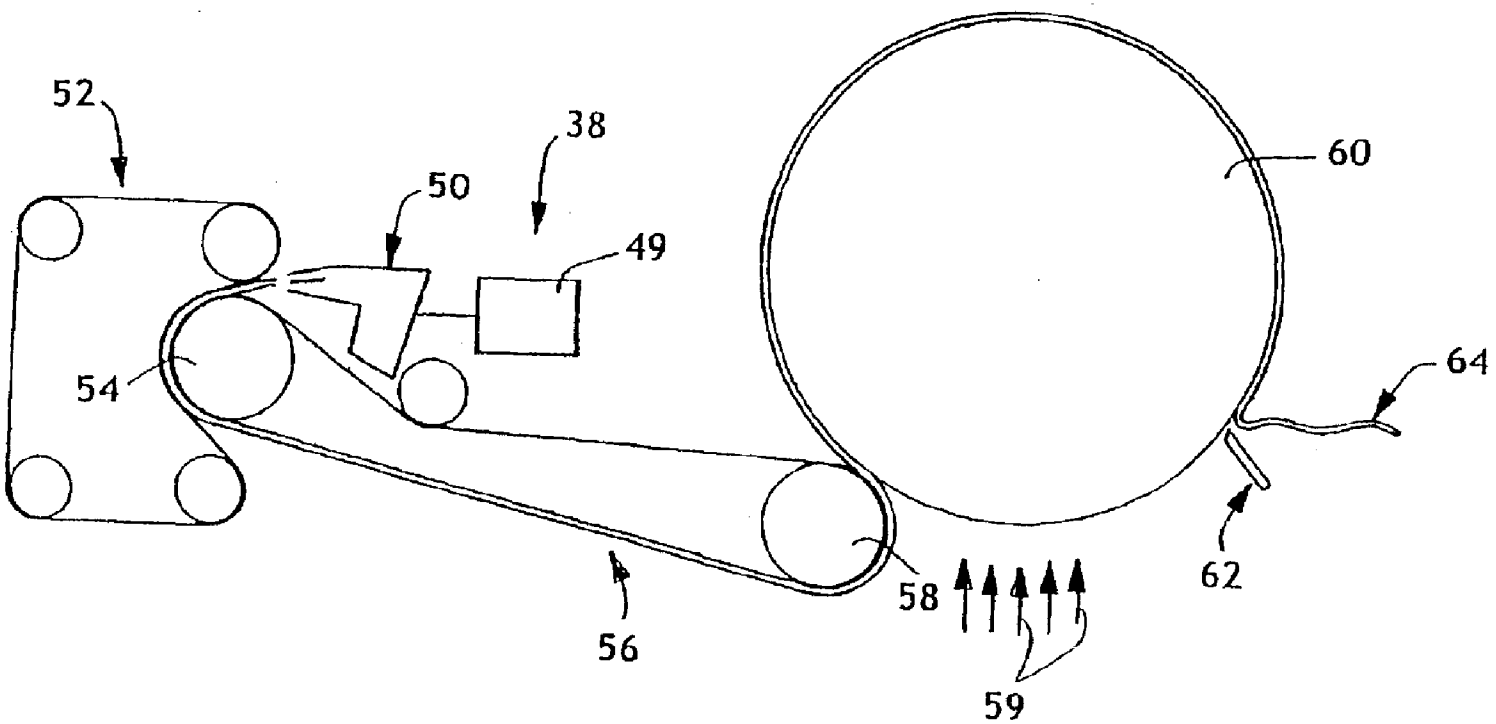
FIG. 3 depicts a schematic process flow diagram of a method of making a creped tissue sheet.

The paper web of the present invention can be formed according to any suitable wet-laid process known in the art. For example, one embodiment for forming the paper web is illustrated in FIG. 3. As seen in the figure, at the paper machines 38, the dried fibrous web 36 is mixed with water for form an amino-functionalized pulp fiber slurry 49. The amino-functionalized pulp fiber slurry 49 contains the pulp fiber having the amino-functional additive retained by the individual fibers. The chemically treated pulp fiber slurry 49 is passed through the paper machine 38 and processed to form a finished product 64.

Referring to FIG. 3, a tissue web 64 is formed using a 2-layer headbox 50 between a forming fabric 52 and a conventional wet press papermaking (or carrier) felt 56 which wraps at least partially about a forming roll 54 and a press roll 58. The tissue web 64 is then transferred from the papermaking felt 56 to the Yankee dryer 60 applying the vacuum press roll 58. An adhesive mixture is typically sprayed using a spray boom 59 onto the surface of the Yankee dryer 60 just before the application of the tissue web to the Yankee dryer 60 by the press roll 58. A natural gas heated hood (not shown) may partially surround the Yankee dryer 60, assisting in drying the tissue web 64. The tissue web 64 is removed from the Yankee dryer by the creping doctor blade 62. Two tissue webs 64 may be plied together and calendared. The resulting 2-ply tissue product may be wound onto a hard roll.

In an alternative embodiment, rather than a wet-pressed paper web, the paper web can be a high bulk, through dried paper web, such as for example, an uncreped through-dried paper web (UCTAD web) as is known in the art.

Countless paper products may be formed from pulp fibers that have been treated according to the present invention. The term "paper" is used herein to broadly include writing, printing, wrapping, sanitary, and industrial papers, newsprints, linerboard, tissue, bath tissue, facial tissue, napkins, wipers, wet wipes, towels, absorbent pads, intake webs in absorbent articles such as diaper, bed pads, meat and poultry pads, feminine care pads, and the like made in accordance with any conventional process for the production of such products. With regard to the use of the term "paper" as used herein includes any fibrous web containing the amino-functionalized cellulosic fibers alone or in combination with other fibers, natural or synthetic. It may be layered or unlayered, creped or uncreped, and may consist of a single ply or multiple plies. In addition, the paper or tissue web may contain reinforcing fibers for integrity and strength.

Reference now will be made to various embodiments of the invention, one or more examples of which are set forth below. Each example is provided by way of explanation of the invention, not as a limitation of the invention. In fact, it will be apparent to those skilled in the art that various modifications and variations may be made of this invention without departing from the scope or spirit of the invention.

EXAMPLE 1

Handsheets were prepared and treanted with a wet-strength resin according to standard processes as are generally known in the art. During the pulping process, a eucalyptus fibrous web was treated with 63 kg/MT of Dow Corning amino-functional silicone fluid (Q2-8220) and then repulped to form amino-functionalized eucalyptus pulp. The handsheets were then prepared from both 100% non-functionalized eucalyptus pulp or a 50/50 mixture of non-functionalized pulp and amino-functionalized pulp, as shown below in Table 1. The handsheets were treated with 20 pounds per ton of Kymene® 557LX, a polyamine-polyamide-epichlorohydrin resin available from Hercules Inc. of Wilmington, Del., that was added to pulp prior to formation of the handsheets.

Tensile indices were obtained as reported in Table 1, below.

TABLE 1

| Code No. | Fiber mix (% non-functionalized/% amino-functionalized | Kymene ® 557 LX added (pounds/ton) | Tensile Index (Nm/g) |
|---|---|---|---|
| Control | 100 | 0 | 13.80 |
| 1 | 100 | 20 | 14.93 |
| 2 | 50/50 | 20 | |
| 3 | 50/50 | 20 | |
| 4 | 50/50 | 20 | |

EXAMPLE 2

Amino-functionalized pulp was prepared by repulping a eucalyptus fibrous web which had Jeffamine® D-2000 (an amine terminated polyoxypropylene diol available from the Huntsman Corporation of Houston, Tex.) applied to the web with a brush at a level of 220 lbs/MT.

Handsheets were prepared according to standard methods as are generally known in the art. Handsheets were formed of either 100% non-functionalized eucalyptus pulp or alternatively of 100% amino-functionalized eucalyptus pulp.

Examples 2 and 4, as shown below in Table 2, were treated with Kymene® 557LX (a polyamine-amide epichlorohydrin resin available from Hercules Inc. of Wilmington, Del.) which was added to the pulp prior to formation of the handsheets as a percentage based on the weight of the fibers.

Four handsheet preparations were examined for strength properties. The results are summarized in Table 2, below.

TABLE 2

| Fiber type | Kymene ® add-on rate | Dry Tensile Index (Nm/g) |
|---|---|---|
| Eucalyptus | 0% | 13 |
| Eucalyptus | 1% | 15 |
| Amino-functionalized Eucalyptus | 0% | 13 |
| Amino-functionalized Eucalyptus | 1% | 5 |

As can be seen in the table, while the addition of 1% Kymene® increases the dry tensile index of the sheet formed of non-functionalized eucalyptus pulp by approximately 15%, the addition of 1% Kymene® to a handsheet formed of the amino-functionalized pulp of the present invention increases the dry tensile index by approximately 48%.

EXAMPLE 3

Amino-functionalized pulp was prepared by repulping a eucalyptus fibrous web which had Jeffamine® T-3000 (a propylene oxide-based triamine available from the Huntsman Corporation of Houston, Tex.) applied to the web with a brush at a level of 30 lbs/MT.

The amino-functionalized fibrous web was repulped and the amino-functionalized pulp made into handsheets. One sample had no strength agent added to the handsheet formed of the amino-functionalized pulp and another included Kymene® added to the amino-functionalized pulp prior to handsheet formation at a 1% add on rate. The dry tensile index of the handsheet which included Kymene® was 15.15 Nm/g, a jump of 63% from the tensile index of 9.31 Nm/g obtained for the handsheet prepared from the amino-functionalized pulp alone, with no strength agent added to the pulp prior to formation of the handsheet.

EXAMPLE 4

Handsheets were prepared using amino-functionalized fiber as prepared in Example 3. Three handsheets were formed with three different add-on levels of Kymene®: 0%, 0.1%, and 0.5% by weight based on the weight of the fibers. The results are shown below in Table 3. As can be seen, even at low levels of Kymene® addition, an unexpectedly large percentage strength increase was seen with the combination of Kymene and amino-functionalized fiber.

| | % Kymene ® addition | Dry Tensile Index (Nm/g) | % Increase in strength over control |
|---|---|---|---|
| Control | 0 | 6.1 | |
| | 0.1 | 8.8 | 46 |
| | 0.5 | 10.1 | 68 |

EXAMPLE 5

Handsheets were prepared with amino-functionalized fibers as prepared in Example 3. Handsheets were formed from 100% amino-functionalized eucalyptus fibers as well as from mixtures of untreated eucalyptus fibers and amino-functionalized fibers. The mixture of fiber ratios examined were 100:00, 50:50, 25:75, and 10:90. For each ratio, 2 handsheets were made—one with 0.5% Kymene® add-on and one without Kymene® strength characteristics were compared between handsheets having identical fiber make-up. The results are shown in Table 4 below. As can be seen, the strength increases were all in the 40+% range.

TABLE 4

| Fiber Ratio Amino-functionalized fiber:non-functionalized fiber | % Kymene ® add-on rate (by weight of fibers) | Dry Tensile Index (Nm/g) | % Increase in Strength |
|---|---|---|---|
| 100:0 | 0 | 4.1 | — |
| 50:50 | 0 | 6.1 | — |
| 50:50 | 0.5 | 9.0 | 45% |
| 25:75 | 0 | 7.8 | — |
| 25:75 | 0.5 | 10.7 | 42% |

TABLE 4-continued

| Fiber Ratio Amino-functionalized fiber:non-functionalized fiber | % Kymene ® add-on rate (by weight of fibers) | Dry Tensile Index (Nm/g) | % Increase in Strength |
|---|---|---|---|
| 10:90 | 0 | 8.2 | — |
| 10:90 | 0.5 | 11.8 | 42% |

EXAMPLE 6

Handsheets were prepared with amino-functionalized fibers as prepared in Example 3. Handsheets were made from 100% amino-functionalized eucalyptus fibers as well as from a 50/50 mixture of untreated eucalyptus fibers and amino-functionalized fibers. For each sample, 2 handsheets were made—one with 0.5% Parez® (a glyoxylated polyacrylamide wet strength agent) and one without Parez®. The results are shown in Table 5 below.

TABLE 5

| Fiber Ratio Amino-functionalized fiber:non-functionalized fiber | Parez ® add-on rate | Dry Tensile Index (Nm/g) | % Increase in Dry Tensile Index |
|---|---|---|---|
| 100:0 | 0% | 4.1 | |
| 100:0 | 0.5% | 12 | 182% |
| 50:50 | 0% | 5.8 | |
| 50:50 | 0.5% | 13.9 | 145% |

A handsheet formed of non-functionalized fibers and 0.5% Parez was not run during this trial. However, earlier handsheet work on a 65% Euc/35% LL19 blend with 0.5% Parez added showed a tensile index increase from 16 to 25, a 56% strength increase.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed is:

1. A papermaking fiber comprising a cellulosic fiber and an amino-functional additive adhered to the fiber, wherein the amino-functional additive has a primary amine content greater than about 0.90 m-eq primary amine per gram amino-functional additive, the amino-functional additive having a retention level on the cellulosic fiber of at least about 50% under aqueous conditions, wherein the amino-functional additive is a substantially water-insoluble polymeric amino-functional additive.

2. The papermaking fiber of claim 1, wherein the amino-functional additive has a primary amine content greater than about 0.94 m-eq primary amine per gram amino-functional additive.

3. The papermaking fiber of claim 1, wherein the papermaking fiber has a Canadian Standard Freeness value greater than about 200.

4. The papermaking fiber of claim 1, wherein the papermaking fiber has a Canadian Standard Freeness value greater than about 500.

5. The papermaking fiber of claim 1, wherein the substantially water-insoluble polymeric amino-functional additive has a solubility of less than about 3 g/100 cc deionized water.

6. The papermaking fiber of claim 1, wherein the amino-functional additive is a polyvinylamine.

7. The papermaking fiber of claim 1, wherein the amino-functional additive is a polyoxyalkylpolyamine.

8. The papermaking fiber of claim 1, wherein the cellulosic fiber and the amino-functional additive are not covalently bon ed together.

9. The papermaking fiber of claim 1, wherein the amino-functional additive has a retention level on the cellulosic fiber of at least about 60% under aqueous conditions.

10. The papermaking fiber of claim 1, wherein the amino-functional additive has a retention level on the cellulosic fiber of at least about 75% under aqueous conditions.

11. The papermaking fiber of claim 1, wherein the papermaking fiber comprises the amino-functional additive in an amount of from about 0.05% to about 5% by weight of the cellulosic fiber.

12. The papermaking fiber of claim 1, wherein the papermaking fiber comprises the amino-functional additive in an amount of from about 0.1% to about 2.5% by weight of the cellulosic fiber.

13. The papermaking fiber of claim 1, wherein the cellulosic fiber is a high yield pulp fiber.

14. The papermaking fiber of claim 1, wherein the cellulosic fiber is a virgin fiber.

15. A paper web comprising:

a plurality of amino-functionalized papermaking fibers comprising a cellulosic fiber adhered to an amino-functional additive, wherein the amino-functional additive has a primary amine content greater than about 0.90 m-eq primary amine per gram, the amino-functional additive having a retention level on the cellulosic fiber of at least about 50% under aqueous conditions, wherein the amino-functional additive is a substantially water-insoluble polymeric amino-functional additive, the amino-functionalized papermaking fibers having no significant fiber degredation; and a papermaking additive capable of reacting with the amino-functionalized papermaking fibers.

16. A paper web as defined in claim 15, wherein th paper web comprises from about 0.05% to about 5% amino-functional additive by eight of the amino-functionalized papermaking fibers.

17. A paper web as defined in claim 15, wherein the paper web comprises from about 0.1% to about 2.5% amino-functional additive by weight of the amino-functionalized papermaking fibers.

18. A paper web as defined in claim 15, wherein the papermaking additive is a wet strength agent.

19. A paper web as defined in claim 18, wherein the dry tensile index of the web is at least about 40% greater than the dry tensile index of a comparable paper web which does not comprise the wet strength agent.

20. A paper web as defined in claim 18, wherein the wet strength agent is a temporary wet strength agent.

21. A paper web as defined in claim 18, wherein the wet strength agent is a permanent wet strength agent.

22. A paper web as defined in claim 15, wherein the papermaking additive is a polymeric anionic reactive compound.

23. A paper web as defined in claim 15, wherein the papermaking additive is a polymeric aldehyde functional compound.

24. A paper web as defined in claim 15, wherein the paper web is a stratified paper web.

25. A paper web as defined in claim 15, comprising between about 0.1% and about 10% papermaking additive by weight of the paper web.

26. A paper web as defined in claim 15, wherein the paper web comprises between about 10% and about 100% amino-functionalized papermaking fibers by weight of the paper web.

27. A paper web as defined in claim 15, wherein the paper web comprises about 50% amino-functionalized papermaking fibers by weight of the paper web.

28. A paper web as defined in claim 15, wherein the amino-functional additive has a primary amine content greater than about 0.9 m-eq primary amine per gram.

29. A paper web as defined in claim 15, wherein the amino-functionalized papermaking fibers have a Canadian Standard Freeness value greater than about 200.

30. A paper web as defined in claim 15, wherein the substantially water-insoluble polymeric amino-functional additive has a solubility of less than about 3 g/100 cc deionized water.

31. A paper web as defined in claim 15, wherein the amino-functional additive is a polyvinylamine.

32. A paper web as defined in claim 15, wherein the amino-functional additive is a polyoxyalkylpolyamine.

33. A paper web as defined in claim 15, wherein the amino-functional additive has a retention level on the cellulosic fiber of at leas about 60% under aqueous conditions.

34. A paper web as defined in claim 15, wherein the amino-functional additive has a retention level on the cellulosic fiber of at least about 75% under aqueous conditions.

35. A paper web as defined in claim 15, wherein the paper web is an uncreped, through-dried paper web.

36. A paper web as defined in claim 15, wherein the paper web is a creped web.

37. A method for forming amino-functionalized pulp fiber comprising:

creating a fiber slurry comprising process water and papermaking fibers;

forming a wet fibrous web comprising said papermaking fibers;

dewatering the wet fibrous web to a consistency of about 30% or greater;

applying an amino-functional additive to the dewatered fibrous web, wherein the amino-functional additive adheres to the papermaking fibers thereby forming a dewatered fibrous web comprising amino-functionalized papermaking fibers; and repulping the dried fibrous web comprising the amino-functionalized papermaking fibers so as to form a slurry of the amino-functionalized papermaking fibers, wherein the amino-functionalized papermaking fibers retain at least about 50% of the amino-functional additive applied to the fibers upon repulping the fibers.

38. The method of claim 37 further comprising curing the amino-functionalized papermaking fibers.

39. The method of claim 37, wherein the amino-functional additive is applied to the paper web in an amount of from about 0.05% to about 5% by weight of the papermaking fibers.

40. The method of claim 37, wherein the amino-functional additive is applied to the paper web in an amount of from about 0.1% to about 2 5% by weight of the papermaking fibers.

41. The method of claim 37, further comprising forming a paper web from said slurry of amino-functionalized papermaking fibers.

42. The method of claim 41, wherein said paper web comprises from about 10% to about 100% amino-functionalized papermaking fibers by weight.

43. The method of claim 41, further comprising applying a papermaking additive to said paper web, wherein the papermaking additive is capable of reacting with the amino-functionalized papermaking fibers.

44. The method of claim 43, wherein the papermaking additive is a wet strength agent.

45. The method of claim 43, wherein the wet strength the agent is a temporary wet strength agent.

46. The method of claim 43, wherein the wet strength the agent is a permanent wet strength agent.

47. The method of claim 43, wherein the papermaking additive is applied to the paper web in an amount of between about 0.1% and about 10% by weight of the paper web.

* * * * *

UNITED STATES PATENT AND TRADEMARK OFFICE

CERTIFICATE OF CORRECTION

PATENT NO. : 6,936,136 B2
APPLICATION NO. : 10/335133
DATED : August 30, 2005
INVENTOR(S) : Thomas G. Shannon and David Moline It is certified that error appears in the above-identified patent and that said Letters Patent is hereby corrected as shown below:

Column 21, line 17, Claim 8, “covalently bon ed together.” should read --covalently bonded together.--

Column 21, line 50, Claim 16, “wherein th paper” should read --wherein the paper--

Column 21, line 52, Claim 16, “additive by eight of the” should read --additive by weight of the--

Column 22, line 21, Claim 28, “than about 0.9 m-eq primary” should read --than about 0.94 m-eq primary--

Column 22, line 34, Claim 33, “fiber of at leas about” should read --fiber of at least about--

Column 23, line 3, Claim 40, “to about 2 5% by weight” should read --to about 2.5% by weight--

Column 24, line 5-6, Claim 45, “the wet strength the agent” should read --the wet strength agent--

Column 24, line 7-8, Claim 46, “the wet strength the agent” should read --the wet strength agent--

Signed and Sealed this

Fifteenth Day of August, 2006

JON W. DUDAS
*Director of the United States Patent and Trademark Office*